US005117340A

United States Patent [19]

Schäfer

[11] Patent Number: 5,117,340

[45] Date of Patent: May 26, 1992

[54] LIGHTING DEVICE

[76] Inventor: Ralf Schäfer, Göllheimer Strasse 10, D-6719 Rüssingen, Fed. Rep. of Germany

[21] Appl. No.: 415,253

[22] PCT Filed: Nov. 9, 1988

[86] PCT No.: PCT/DE88/00694

§ 371 Date: Sep. 6, 1989

§ 102(e) Date: Sep. 6, 1989

[87] PCT Pub. No.: WO89/04436

PCT Pub. Date: May 18, 1989

[30] Foreign Application Priority Data

Nov. 9, 1987 [DE] Fed. Rep. of Germany ..... 3738007

[51] Int. Cl.[5] ..... F21S 7/00

[52] U.S. Cl. ..... 362/148; 362/150; 362/248; 362/404

[58] Field of Search ..... 362/147, 248, 404, 419, 362/148, 150

[56] References Cited

U.S. PATENT DOCUMENTS

| | | | |
|---|---|---|---|
| 3,504,172 | 3/1970 | Liberman | 362/150 |
| 4,263,639 | 4/1981 | Schacht | 362/147 |
| 4,685,038 | 8/1987 | Huang | 362/147 |
| 4,907,137 | 3/1990 | Schladitz et al. | 362/147 |

*Primary Examiner*—Carroll B. Dority

*Attorney, Agent, or Firm*—Herbert L. Lerner; Laurence A. Greenberg

[57] ABSTRACT

A lighting device comprises a support plate having first and second sides and a current supply attached to the first side; a structure for supporting the support plate at a distance from a surface of a room is provided, defining a laterally open space between the support plate and the surface; a leg having first and second ends, the first end penetrating the plate and protruding from the second side; a first socket is attached to the second end for attaching and electrically connecting a light bulb, and a second socket is disposed on the first side in the space for attaching and electrically connecting a further light bulb for indirectly lighting the room. The plate may be spaced from the surface by a cast resin body into which the current supply is embedded, or by a holder in the form of a multi-legged holder star.

16 Claims, 2 Drawing Sheets

LIGHTING DEVICE

Figure 1:
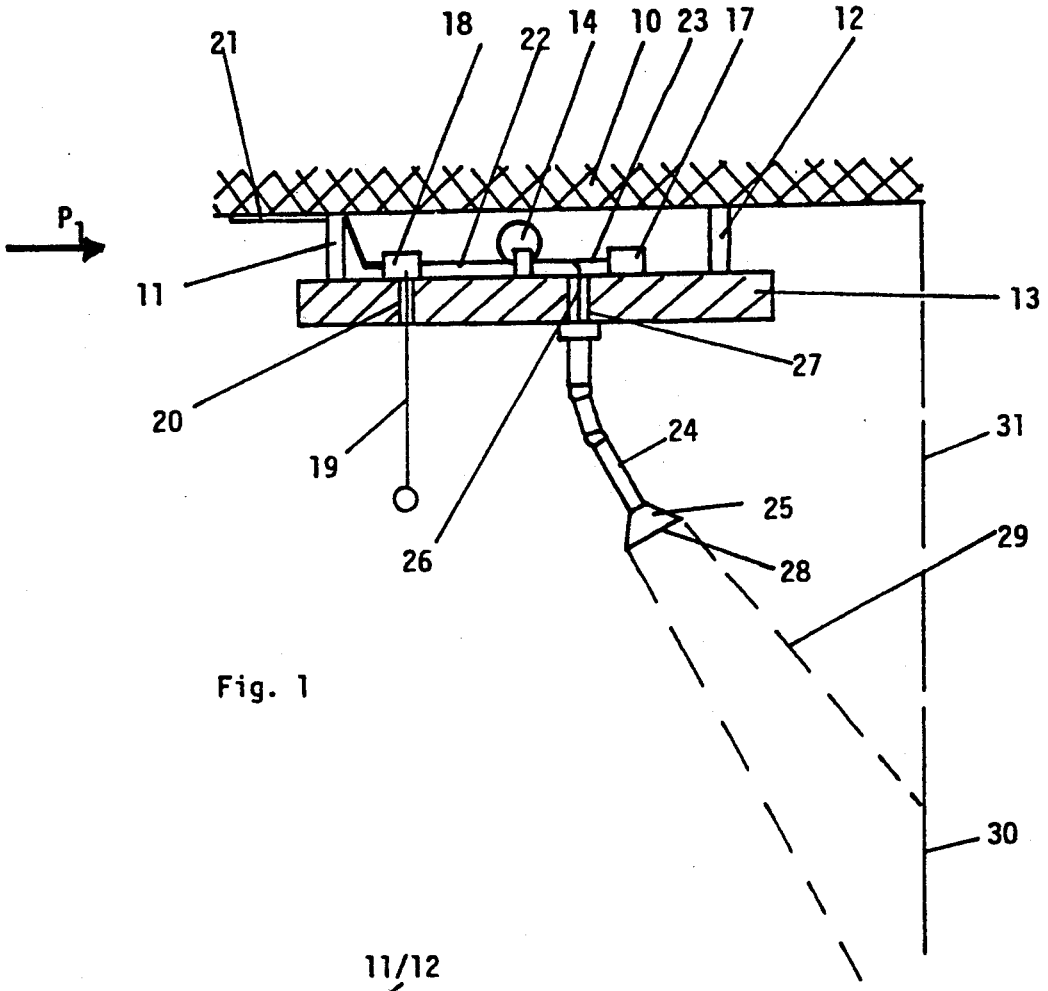

The invention relates to a lighting device to be supported by the surface of a room, such as the ceiling, a wall or the floor, having a support and a bulb attached thereto and a current supply for the bulb.

German Utility Model 74 35 540 discloses a track light for spotlights, which has a closed, water-tight, elongated housing which holds supply devices for the spotlights, with supply lines leading into the housing and with supply lines extending from the housing to the outside in a water-tight manner. At least one spotlight is secured by means of a fastening bracket to the track, which has a double T profile in cross section. The track light is essentially suitable only for spotlighting; it is of little use as general room illumination, especially because it is esthetically unattractive and is virtually unusable for public reception rooms and living rooms decorated in a sophisticated manner.

A similar lighting device is known from German Utility Model 86 19 144, on which a plurality of lights operated at low voltage can be secured. This arrangement is once again not readily usable for general room lighting, for similar reasons.

The object of the invention is to devise a lighting device of the above type that is esthetically attractive and can also be used for general room lighting, in living rooms or office spaces and the like, in which an esthetically decorative appearance is important.

According to the invention, this object is attained in that the support is in the form of a plate; the current supply is attached to the plate on its side facing the room surface by which the lighting device is supported; a rigid or flexible leg is secured to and penetrates the plate; the bulb is attached to the free end of the leg.

With the embodiment according to the invention, a light is devised that can be used particularly in public reception rooms. The support plate, which in a particularly advantageous manner, may be produced from stone or stone-like material, and optionally from plastic or metal as well, can have the most various external contour; this has particular advantages when slate, granite or marble is used. The external contour can be regular, in the form of a circle, ellipse or polygon, or can be made in such a way that unneeded parts are broken off. This produces a interrupted contour, which is esthetically highly attractive.

Especially when slate, granite or marble is used, and wood as well, as an organic material, particular attention must be paid to the fastening of the electric current supply device. In accordance with a further embodiment of the invention, the current supply device elements are embedded in a cast resin body which is cast on the support plate; at least one lamp socket, for so-called indirect lighting, can be embedded in this body as well.

Accordingly, all the components that must be accommodated on the back of the support plate—that is, the side facing the ceiling, wall or floor—are secured to the support plate by the cast resin body, and the cast resin body itself can be used for retaining the support plate and thus the light on a ceiling or on a wall, so special means engaging the support plate itself, such as screw bolts penetrating the plate, can be dispensed with.

For fixation of the cast resin body to the plate, form-locking parts are suitably provided, such as cap screw bolts, for instance glued into blind bores in the plate, having their caps surrounded by the cast resin and thus received in it in a form-locking manner.

For fixation of the light to the ceiling, a cup may be provided that partly surrounds the cast resin body and includes screws that can be screwed into an encompassing groove on the cast resin body. The cup is then secured to the ceiling or wall. Instead of an encompassing groove, bores provided at suitable points, that is, blind bores, may naturally also be used, into which the screw bolts can be screwed. Instead of a cup, a three-legged holder—if the cast resin body has a circular cross section—or a four-legged holder—if it has a rectangular cross section—may also be used, which has L-shaped legs, the free ends of which partly cover the cast resin body over its outside circumference.

If rigid or flexible legs are used as supports for the bulbs, then the ends of the legs remote from the lamps are inserted into bores in the support plate and glued firmly there, the ends protruding partway into the cast resin body and thus contributing to additional fixation of the cast resin body to the support plate.

Further advantageous embodiments of and improvements to the invention are disclosed in the further dependent claims. If the support plate is made of wood, metal or plastic, then it may be embodied as hollow, so as to be able to form a receiving space for the supply devices.

An economically particularly advantageous feature is that the support plate can be embodied as a prefabricated unit in the factory, containing fluorescent bulbs, spotlights and supply devices, for many kinds of uses in the home, in exhibition halls, and in the office field.

The invention will now be described in further detail, along with further embodiments and improvements and further advantages of the invention, referring to the drawing, in which two exemplary embodiments of the invention are shown.

Figure 2:
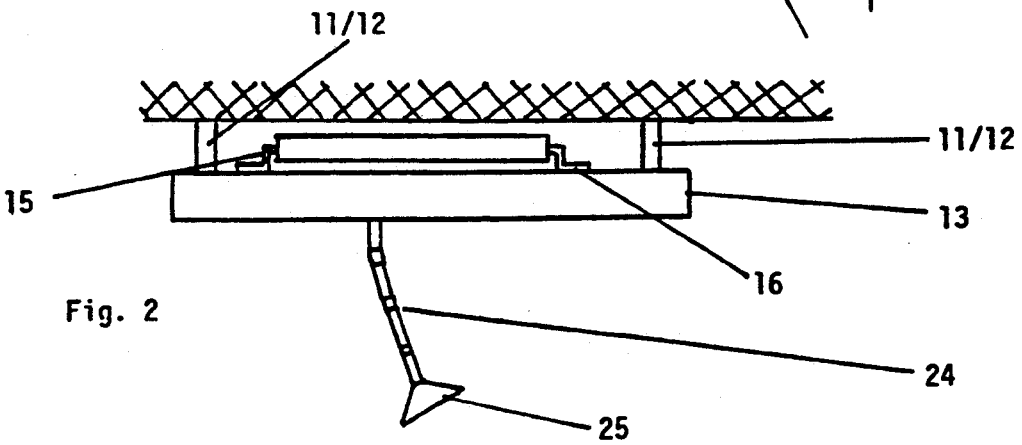
Figure 3:
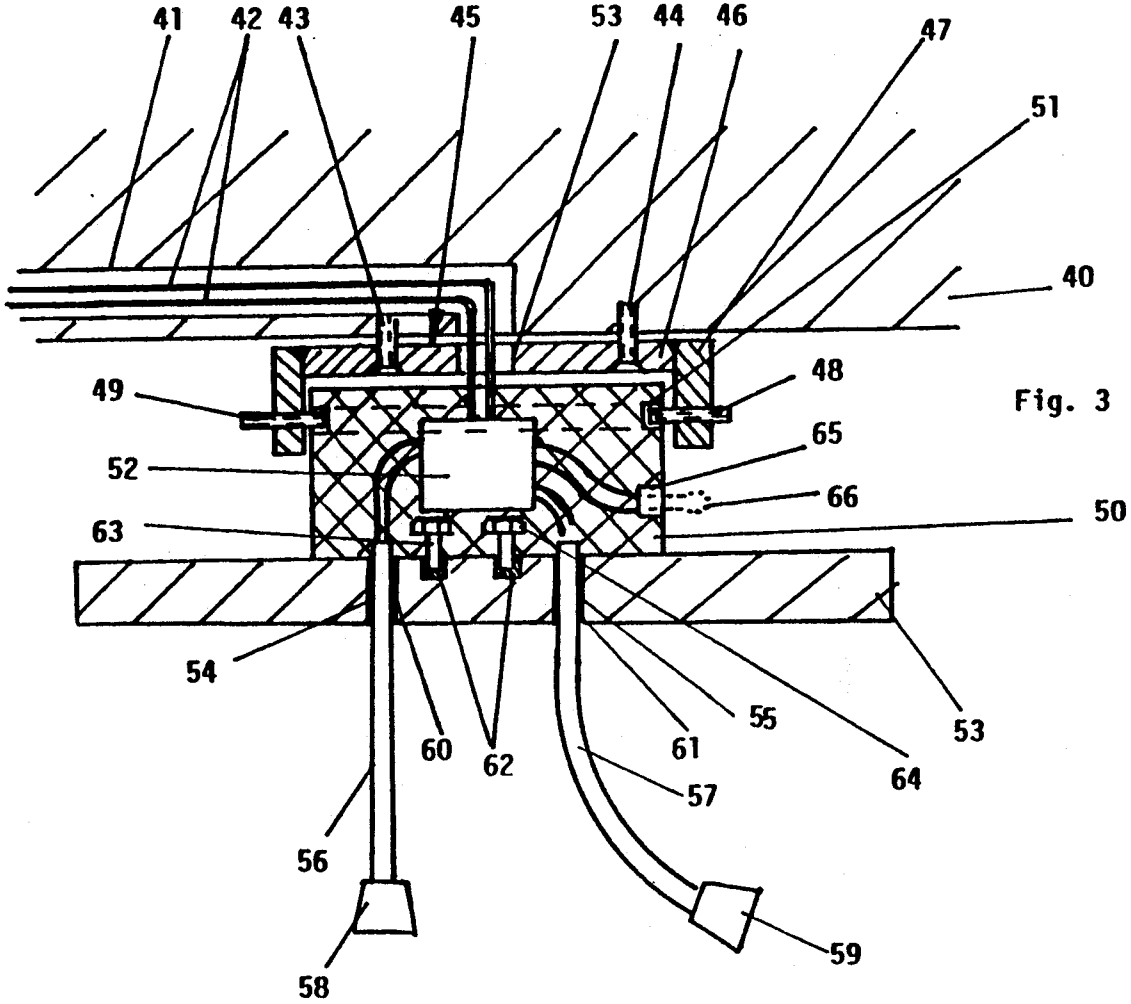

Shown are:

FIG. 1, a side view of the lighting device;

FIG. 2, a view transversely to FIG. 1 on the lighting device according to the invention; and FIG. 3, a further lighting device according to the invention.

A plate-like support 13 is secured under a ceiling 10 by means of holders 11 and 12. Located on the top of the support 13 is a fluorescent tube 14, which is retained in a known manner inside its sockets 15 and 16, which are secured on the support 13, also called a support plate. Instead of a single fluorescent tube 14, a plurality of fluorescent tubes may also be used. The support 13 is preferably made from stone, particularly slate or granite; naturally, it may also be made from metal coated with a coated layer, preferably anodized aluminum, wood, plastic or the like. Located on the support 13 besides the fluorescent bulb 14 are a choke 17 and a switch 18, here embodied as a cord switch. The cord 19 extends through a bore 20 in the support and can be actuated from below.

Supply lines 21 run to this switch 18, and further supply lines 22 and 23 run from the switch 18 and the choke to the fluorescent bulb 14. A spotlight 25, secured to a goose neck 24, is also accommodated on the underside of the support 13, being supplied with electric current via a supply line 26 that is passed through a further bore 27 in the support 13. The bulb inside the spotlight 25 is preferably a halogen bulb, and the spotlight has a beam reflector 28, with which, in addition to the indirect light effected via the reflection of the light rays of the fluorescent bulb 14 from the ceiling 10, a beam of light 29 can be radiated to a specific point 30 on a wall 31; this is merely suggested by dashed lines here. The goose neck 24 is known per se and is used to enable bending or otherwise moving the spotlight 25 into the correct position.

FIG. 2 shows the embodiment of FIG. 1 in a view in the direction of the arrow P 1; it can be seen that a cord corresponding to the cord 19 has not been shown here. This arrangement according to FIG. 2—naturally that of FIG. 1 as well, which except for the cord switch is identical to that of FIG. 2 13 can preferably be actuated in the usual way by a switch secured to the wall, and either the fluorescent bulb 14 or the spotlight 25, or both simultaneously, can be switched on or off. A dimmer device is also possible, in the event that both the bulb for the spotlight and the fluorescent bulb 14 can be regulated in brightness in an infinitely adjustable manner by means of a suitable control device. In that case, the choke 17 may be an electronic choke.

It should be noted that the support 13, with the spotlight 25 and the fluorescent bulb 14 with the sockets 15 and 16 as well as with the holder elements 11/12, can be made as a unit in the factory. In a preferred manner, the material from which the support 13 is made is stone, particularly a stone material of a kind that can be relatively easily machined, and in particular easily drilled. Naturally any other kinds of material may also be used for the support 13.

A further preferred embodiment is shown in FIG. 3. On a ceiling 40, in which a duct 41 is laid under plaster to carry electric cables 42, with the cables 42 protruding from the ceiling 40, a cup 45 is secured by means of screw bolts 43 and 44, the cup being composed of a plate 46 and a cylindrical ring 47 attached to it, preferably being joined by welding. Screws 48 and 49 are provided on the outer circumference of the cylindrical ring 47, penetrating the cylindrical ring 47 transversely to the center axis of the cylindrical ring 47. The screws 48 engage the groove 51 on a cast resin body 50; the groove 51 is provided on the outer circumference of the cast resin body 50. A current supply device 52, schematically represented by a box, is provided in the interior of the cast resin body, and the cables 42 are introduced into it. To enable carrying the cable 42 through the plate 46, the plate 46 has a central bore 53. A current supply device 52 may for instance be a transformer.

The cast resin body 50 is secured to a plate 53, which has a plurality of bores 54, 55 (in FIGS. 3, 2 in the drawing), through which the legs 56 and 57 of bulbs 58 and 59 are passed, in such a way that they protrude beyond the plate 53 on the side toward the cast resin body 50. Inside the bores 54 and 55, the legs 55 and 56 are firmly glued by means of adhesive 60 and 61. The plate 53 has blind bores 62 on the face toward the cast resin body, into which screw bolts 63 can be screwed, each with one screw cap 64; the caps 64 are surrounded by cast resin and thus serve to provide form-locking retention of the cast resin body on the plate 53.

The drawing also shows that a socket 65 is cast integral with the cast resin body 50 on its outside circumference, and a bulb 66 can be inserted into the socket for indirect lighting.

The production of the cast resin body is effected in that a divided mold (not shown in further detail) is placed upon the plate 53, after the insertion of the legs 56 and 57 along with the wiring and after the attachment of the current supply device to the plate, or optionally onto the screw bolt caps on the plate 53; the space formed by this mold is then filled with casting resin, so that the cast resin body 50 shown in FIG. 3 is formed. Connection lines then protrude from this cast resin body and are connected to the connection cables 42, optionally via chandelier clamps or similar components. Naturally the connection cables laid under plaster cannot be introduced directly into the cast resin body, but rather only via couplings, such as the aforementioned chandelier clamps.

Instead of a cup 45 welded as shown in FIG. 3, a deep-drawn cup may be used, which is embodied and produced in the same manner. Likewise, instead of the screws 63/64, hook elements can be glued into the plate 53; the important factor is that these elements have a head-like enlargement so that they are form-lockingly surrounded by casting resin.

In order to introduce the socket 65 into the cast resin body, the socket is mounted on the inside surface of the mold, in such a way that no casting resin can flow into the bushings of the socket 65. When the mold is removed, the socket remains in the cast resin body.

The legs 56, 57 may be embodied as rigid or flexible.

If suitable holders are attached to the cast resin body 50, the lighting device can also be set on the floor, in such a way that the plate 53 extends parallel to the floor.

The external shape of the plate 53 may be irregular; it may be circular or polygonal. If the plate 53 is made of a slab of stone, then it is suitably formed by breaking off so-called excess parts.

Although not shown, the support plate 53 may also have a clock attached to it; this electric clock can then be supplied with current via the current supply device 52 inside the cast resin body 50.

I claim:

1. A lighting device, comprising a support plate having first and second sides, a current supply attached to said first side, means for supporting said support plate at a distance from a surface of a room, defining a laterally open space between said first side and the surface, a leg having first and second ends, said first end penetrating said plate and protruding from said second side, first socket means attached to said second end for attaching and electrically connecting a light bulb, and second socket means disposed on said first side in said space for attaching and electrically connecting a further light bulb for indirectly lighting the room.

2. The lighting device according to claim 1, wherein said leg is a rigid leg.

3. The lighting device according to claim 1, wherein said leg is a flexible leg.

4. The lighting device according to claim 1, wherein said plate is made of a material selected from the group consisting of stone, stone-like material, metal, and organic materials.

5. The lighting device according to claim 1, wherein said plate has a thickness of substantially from 2 to 3 cm.

6. The lighting device according to claim 1, wherein said plate is in the form of a polygon.

7. The lighting device according to claim 1, wherein said plate is in the form of a circle.

8. The lighting device according to claim 1, wherein said plate is made of stone selected from the group consisting of slate, granite and marble, and said plate having external contours formed by being broken out.

9. The lighting device according to claim 1, including a cast resin body secured to said plate by casting, said current supply being embedded in said cast resin body.

10. The lighting device according to claim 9, wherein said second socket means is embedded in said cast resin body.

11. The lighting device according to claim 9, wherein said cast resin body has a circular cross section and at least one recess formed therein for receiving and retaining fastening means.

12. The lighting device according to claim 11, wherein said recess is in the form of an groove extending around said cast resin body.

13. The lighting device according to claim 11, wherein said at least one recess is in the form of a plurality of blind bores.

14. The lighting device according to claim 11, including a cup to be secured to the surface of the room, said cup having cup walls being adapted to the external dimensions of said cast resin body and partly encompassing said cast resin body, and fastening means extending through said cup walls into said at least one recess for force-lockingly retaining said cup on said cast resin body.

15. The lighting device according to claim 1, wherein said plate is formed of inorganic material.

16. The lighting device according to claim 1, wherein said plate has an outside contour, said contour having an irregular shape.

* * * * *